US005941200A

United States Patent [19]

Boros et al.

[11] Patent Number: 5,941,200

[45] Date of Patent: Aug. 24, 1999

[54] GAS-FIRED WATER HEATER HAVING PLATE-MOUNTED REMOVABLE BOTTOM END BURNER AND PILOT ASSEMBLY

[75] Inventors: Jozef Boros, Elora, Canada; Dale A. Southerland, Eclectic, Ala.

[73] Assignee: The Water Heater Industry Joint Research and Development Consortium, Reston, Va.

[21] Appl. No.: 09/003,634

[22] Filed: Jan. 7, 1998

[51] Int. Cl.[6] ..... F22B 5/00

[52] U.S. Cl. ..... 122/13.1; 122/14; 122/17; 122/504; 126/350 R; 126/361

[58] Field of Search ..... 122/13.1, 14, 17, 122/504; 126/350 R, 361, 363

[56] References Cited

U.S. PATENT DOCUMENTS

| | | | |
|---|---|---|---|
| 360,199 | 3/1887 | Boegler . | |
| 626,454 | 6/1899 | Brinthall . | |
| 796,924 | 8/1905 | McCartney et al. . | |
| 1,398,986 | 12/1921 | Warnock . | |
| 1,661,193 | 3/1928 | Newport . | |
| 1,692,839 | 11/1928 | Humphrey . | |
| 1,806,216 | 5/1931 | Plummer . | |
| 2,008,155 | 7/1935 | Ramsdell et al. | 122/19 |
| 2,036,136 | 3/1936 | Guarcello | 122/19 |
| 2,070,535 | 2/1937 | Hansen | 158/2 |
| 2,112,655 | 3/1938 | Morrow | 122/494 |
| 2,429,916 | 10/1947 | Belgau | 237/67 |
| 2,499,636 | 3/1950 | Finley | 122/17 |
| 2,559,110 | 7/1951 | Burwell | 122/14 |
| 3,139,067 | 6/1964 | van den Broek et al. | 122/18 |
| 3,741,166 | 6/1973 | Bailey | 122/23 |
| 4,191,173 | 3/1980 | Dedeian et al. | 126/350 R |
| 4,510,890 | 4/1985 | Cowan | 122/17 |
| 4,641,631 | 2/1987 | Jatana | 122/14 |
| 4,777,933 | 10/1988 | Ruark | 126/361 |
| 4,817,564 | 4/1989 | Akkala et al. | 122/17 |

FOREIGN PATENT DOCUMENTS

WO 97/14916 4/1997 WIPO .

OTHER PUBLICATIONS

1989 Coast Guard Final Report–"Testing of Flame Screens and Flame Arrestors as Devices Designed to Prevent the Passage of Flame (DPPF) into Tanks Containing Flammable Atmospheres . . . ".

(List continued on next page.)

*Primary Examiner*—Teresa Walberg
*Assistant Examiner*—Jiping Lu
*Attorney, Agent, or Firm*—Konneker & Smith, P.C.

[57] ABSTRACT

A fuel-fired water heater has a combustion chamber disposed beneath the storage tank portion of the water heater. The bottom side wall of the combustion chamber is defined by an annular perforated wall structure with a perforated mounting plate structure being removably secured to the underside of the wall structure over the central opening therein. A burner and associated pilot/thermocouple assembly are secured to the upper side of the mounting plate and project upwardly into the combustion chamber, with the piping and wiring of the burner and pilot/thermocouple assembly extending externally beneath the combustion chamber, outwardly through a side wall access passage, and then turning upwardly along the outside of the water heater for connection to a thermostatic fuel valve. To remove the bottom plate-mounted burner and pilot/thermocouple assembly the fuel supply piping must first be decoupled from the thermostatic valve, thereby assuring that the access plate cannot be removed while the burner is firing. The combustion chamber is essentially sealed to prevent combustion air inflow thereto except through the perforations in its bottom side wall structure. These perforations are configured and sized to permit upward combustion air inflow therethrough into the combustion chamber with a minimal pressure drop, while also acting as flame arrestors to hinder downward flame flow therethrough potentially caused by upward inflow of flammable vapors and subsequent ignition thereof within the interior of the combustion chamber.

28 Claims, 3 Drawing Sheets

U.S. PATENT DOCUMENTS

| | | | |
|---|---|---|---|
| 4,872,443 | 10/1989 | Ruark | 126/361 |
| 4,924,816 | 5/1990 | Moore, Jr. et al. | 122/17 |
| 5,020,512 | 6/1991 | Vago et al. | 126/350 R |
| 5,261,438 | 11/1993 | Katchka | 137/15 |
| 5,355,841 | 10/1994 | Moore, Jr. et al. | 122/17 |
| 5,427,525 | 6/1995 | Shukla et al. | 431/350 |
| 5,435,716 | 7/1995 | Joyce | 431/7 |
| 5,494,003 | 2/1996 | Bartz et al. | 122/17 |
| 5,511,516 | 4/1996 | Moore, Jr. et al. | 122/17 |
| 5,533,495 | 7/1996 | Moore, Jr. | 126/350 R |
| 5,791,298 | 8/1998 | Rodgers | 122/17 |
| 5,797,355 | 8/1998 | Bourke et al. | 122/13.1 |
| 5,797,358 | 8/1998 | Brandt et al. | 122/448.1 |

GAS-FIRED WATER HEATER HAVING PLATE-MOUNTED REMOVABLE BOTTOM END BURNER AND PILOT ASSEMBLY

BACKGROUND OF THE INVENTION

The present invention generally relates to fuel-fired water heaters and, in a preferred embodiment thereof, more particularly provides a gas-fired water heater having incorporated therein a specially designed plate-mounted removable bottom end burner and pilot assembly circumscribed by a flame arresting combustion air intake structure.

Gas-fired residential and commercial water heaters are generally formed to include a vertical cylindrical water storage tank with a gas burner disposed in a combustion chamber below the tank. The burner is supplied with a fuel gas through a gas supply line, and combustion air through one or more air inlet openings providing communication between ambient air and the interior of the combustion chamber.

Water heaters of this general type are extremely safe in operation. However, when gasoline or other flammable liquids are stored or used improperly in proximity to the water heater, there may exist a possibility of flammable vapors becoming entrained in the air intake of the water heater. It is theorized that such vapors might cause secondary combustion to occur within the confines of the water heater combustion chamber. It is accordingly possible for the resulting flame to propagate out of the combustion chamber into the ambient environment around the water heater as a result of following the intake path of the flammable vapor.

In conventionally constructed water heaters of this general type, a combustion chamber access door is typically provided in a vertical side wall portion of the water heater, with the burner and pilot gas supply lines extending horizontally through the access door into the combustion chamber and connected to their associated burner and pilot structures within the combustion chamber. This access door design can possibly provide a potential leakage path between the combustion chamber and the exterior of the water heater. Another potential leakage path is presented by the inlet passage used to flow ambient combustion air into the combustion chamber. For water heater designs focusing on controlling the entrance location of flammable vapors passing into the combustion chamber it would be desirable to provide a sealed access structure for the combustion chamber and to hinder the entrance of flammable vapors into the combustion chamber via an unintended combustion air inflow path. It is to these goals which the present invention is directed.

SUMMARY OF THE INVENTION

In carrying out principles of the present invention, in accordance with a preferred embodiment thereof, an improved fuel-fired water heater is provided. The water heater is representatively a gas-fired water heater, but could alternatively be an oil-fired water heater, and includes a tank adapted to hold a quantity of water, and a combustion chamber disposed beneath the tank and having a bottom side wall structure with a burner mounting opening extending upwardly therethrough.

A mounting plate structure is secured to the underside of the bottom side wall structure, over the burner mounting opening, and is downwardly removable from the bottom side wall structure. Secured to the top side of the mounting plate structure for downward removal therewith from the bottom side plate structure is a fuel burner which projects upwardly into the combustion chamber through the burner mounting opening in the bottom side wall structure. The burner is operatively connected to a fuel supply pipe that is disposed externally of the combustion chamber and is removably coupled to a fuel valve device, representatively a thermostatic gas valve, externally mounted on the water heater. A single seal element, illustratively an annular high temperature sealing gasket, is used to seal the mounting plate structure to the underside of the bottom side wall structure.

According to a feature of the present invention, it is necessary to decouple the fuel supply pipe from the fuel valve device to remove the mounting plate structure from the bottom side wall structure and thereby uncover the burner mounting opening. Thus, the burner mounting opening cannot be uncovered while the burner is firing. Additionally, when the mounting plate structure is replaced, its operative re-sealing to the bottom side wall structure of the combustion chamber can be more easily and reliably achieved using the single seal element interposed between the mounting plate structure and the bottom side wall structure.

An air inlet path is provided through which combustion air may be flowed into the interior of the otherwise sealed combustion chamber, a portion of this air inlet path being defined by a spaced series of openings formed in the bottom side wall structure, and preferably in the mounting plate structure as well. According to another aspect of the present invention, these openings act as flame arrestors to inhibit flame outflow therethrough from within the combustion chamber as might possibly occur in the event that flammable vapors passing upwardly through the openings were to be ignited within the combustion chamber during operation of the water heater.

The combustion air inlet openings disposed on the bottom side of the combustion chamber are sized and configured to (1) freely permit upward combustion air flow therethrough into the combustion chamber, and at the same time (2) hinder flame outflow downwardly through the combustion air inlet openings. Preferably, these openings have predetermined hydraulic diameter characteristics causing them to quench a flame passing downwardly therethrough.

Illustratively, the bottom side wall structure and the mounting plate structure are each of a steel construction and are approximately 0.25 inches thick, each of the spaced series of combustion air inlet openings has a generally circular cross-section with a diameter of approximately 0.063 inches, and the openings have a center-to-center spacing of approximately 0.125 inches. Preferably, the bottom side wall structure and the mounting plate structure are each formed from a plurality of stacked perforated steel plates (representatively four in number) in which the perforations therein are in registry with one another to combinatively form the combustion air inlet openings. Alternatively, each of the bottom side wall structure and the mounting plate structure could be of a one piece metal construction, and the combustion air inlet openings could be formed only in the bottom side wall structure.

In a preferred embodiment thereof, the water heater further includes a hollow skirt structure extending downwardly beyond the bottom side wall structure and having a vertical side wall portion with a spaced series of inlet openings formed therein for permitting a combustion air inflow therethrough into the interior of the hollow skirt structure for delivery therefrom into the combustion chamber via the combustion air inlet openings in the bottom side of the combustion chamber.

Additionally, in the preferred water heater embodiment an insulating jacket structure circumscribes the tank. The insulating jacket structure has an outer wall portion with a lower end section that outwardly circumscribes the hollow skirt structure and defines therewith an air inlet plenum. The lower end section of this outer jacket wall portion has a spaced series of air inlet openings therein that permit combustion air to flow inwardly therethrough into the air inlet plenum for delivery therefrom into the interior of the hollow skirt structure through the inlet openings in its vertical side wall portion.

The vertical side wall portion of the skirt structure and the outer jacket wall portion preferably have aligned access openings formed therein through a horizontal portion of the fuel supply pipe outwardly passes before turning upwardly to its coupling location on the thermostatic fuel valve. The mounting plate structure, the fuel burner, and a portion of the fuel supply pipe are outwardly removable through the access openings when the fuel supply pipe is decoupled from the thermostatic fuel valve and the mounting plate structure is downwardly removed from the bottom side wall structure of the combustion chamber. A suitable removable cover plate is externally attached to the water heater to cover the access openings until removal of the fuel burner is desired.

DETAILED DESCRIPTION

Figures 1, 2, 3:
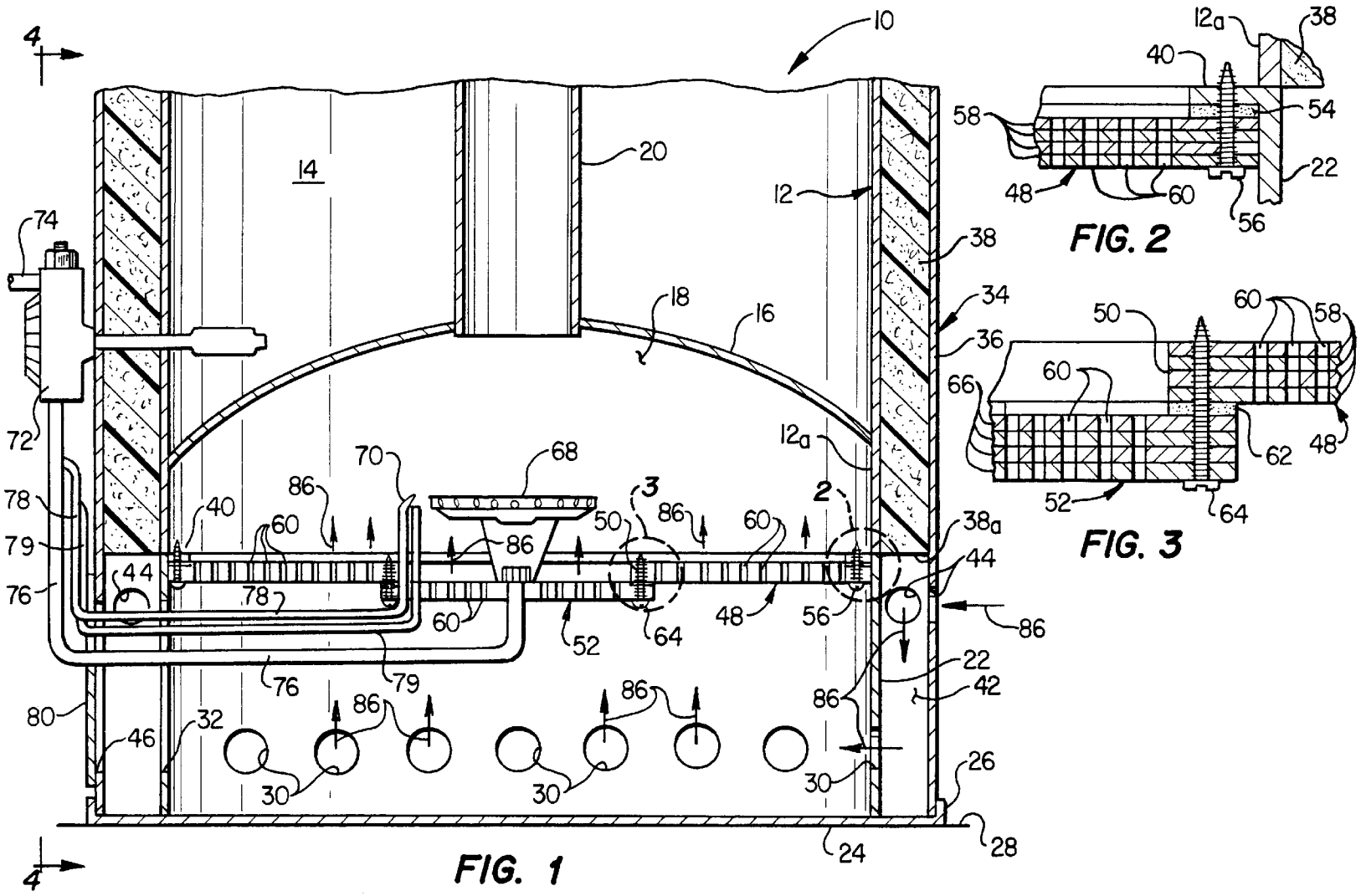
FIG. 1 is a simplified partial cross-sectional view through a gas-fired water heater embodying principles of the present invention and having a removable bottom end-mounted burner and pilot assembly circumscribed by a flame outflow-arresting air inlet structure.
FIG. 2 is an enlarged detail view of the dashed circle area "2" in FIG. 1.
FIG. 3 is an enlarged detail view of the dashed circle area "3" in FIG. 1.

Cross-sectionally illustrated in simplified form in FIG. 1 is a lower end portion of a specially designed fuel-fired water heater 10 embodying principles of the present invention. Illustratively, the fuel-fired water heater 10 is a gas-fired water heater, utilizing natural or liquified petroleum gas, but could alternatively be an oil-fired water heater. Water heater 10 has a vertically oriented cylindrical metal water storage tank 12 in which a quantity of heated water 14 is stored, the tank 12 having an upwardly domed bottom head portion 16 that defines the upper wall of a combustion chamber 18 which communicates with the open lower end of a combustion flue tube 20 that centrally extends upwardly through the interior of the tank 12. An annular outer side wall portion of the combustion chamber 18 is defined by an annular lower end portion 12*a* of the tank which extends downwardly past the periphery of the bottom head portion 16. In a conventional manner suitable outlet and inlet pipes (not shown) are connected to the tank 12 to respectively flow heated water out of the tank and flow water to be heated into the tank.

The lower end portion 12*a* of the tank 12 is supported atop an annular skirt structure 22 having an open lower end 24 which is received in a bottom pan member 26 that rests on a suitable horizontal support surface such as the indicated floor 28. A circumferentially spaced array of combustion air inlet openings 30 are formed in the vertical side wall portion of the skirt structure 22 near the bottom end 24 of the skirt, and an access opening 32 is formed in the skirt 22 in a left portion thereof as viewed in FIG. 1.

Outwardly circumscribing the tank 12 is a cylindrical insulating jacket structure 34 having an annular outer metal jacket portion 36 which is coaxial with the tank 12 and spaced outwardly therefrom. A suitable insulation material, such as foam insulation 38, is disposed within the annular space between the metal jacket portion 36 and the tank 12. The lower end of the metal jacket portion 36 is received within the bottom pan 26, and the insulation 38 has an annular lower end surface 38*a* which is spaced upwardly apart from the lower end of the jacket portion 36 and is vertically adjacent an annular, inturned flange 40 formed on the upper end of the skirt 22 (see FIG. 2).

The absence of insulation 38 vertically along the skirt 22 forms an annular air intake plenum space 42 between the skirt 22 and a lower end section of the jacket portion 36. At the upper end of the plenum 42 a circumferentially spaced series of air inlet openings 44 are formed in the jacket portion 36. Additionally, an access opening 46 is formed in a left side of the skirt 22 (as viewed in FIG. 1) and is aligned with the access opening 32 formed in a left side portion of the skirt 22.

The bottom side wall of the combustion chamber 18 is positioned at the top side of the skirt structure and is defined by (1) an annular, perforated bottom side wall structure 48 having a central circular burner mounting hole 50, and (2) a circular perforated mounting plate structure 52. As best illustrated in FIG. 2, the bottom side wall structure 48 is positioned beneath the skirt flange 40, with an annular high temperature sealing gasket 54 being interposed between a peripheral edge portion of the bottom side wall structure 48 and the skirt flange 40. This peripheral edge portion of the bottom side wall structure 48 is sealed to the underside of the flange 40 by a circumferentially spaced series of screws 56 extending upwardly through the periphery of the bottom side wall structure 48, and the flange 40, and compressing the gasket 54.

Preferably, the bottom side wall structure 48 is formed from a stacked plurality of annular perforated metal plates 58 (representatively four in number), with the perforations in the plates 58 being in registry with one another to combinatively define a spaced series of vertical combustion air intake openings 60 vertically extending from the bottom side of the bottom side wall structure 48 to its top side. The illustrated openings 60 have circular cross-sections along their lengths, but could alternatively have other cross-sectional configurations. While the bottom side wall structure 48 is illustratively formed from a stacked plurality of perforated plates, it will be appreciated that if desired it could be alternatively formed from a single thicker plate.

The mounting plate structure 52 extends along a central lower side portion of the bottom side wall structure 48 and covers the burner mounting hole 50 therein (see FIGS. 1 and 3). A high temperature sealing gasket 62 is interposed between facing peripheral portions of the mounting plate structure 52 and the burner mounting opening 50, with a circumferentially spaced series of screws 64 extending upwardly through the overlapping peripheral portions of the bottom side wall structure 48 and the mounting plate structure 52 and compressing the gasket 62 to form a peripheral seal between the bottom side wall structure 48 and the mounting plate structure 52.

Figure 3A:
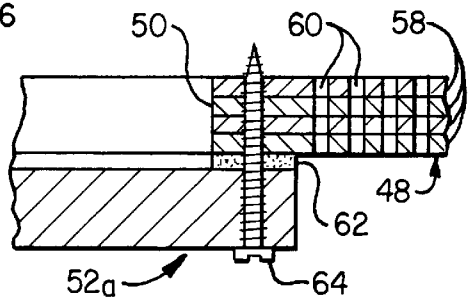
FIG. 3A is a view similar to that in FIG. 3, but showing an alternate construction of a plate structure upon which the burner and pilot assembly is mounted.

Like the annular bottom side wall structure 48, the circular mounting plate structure 52 is formed from a stacked plurality of perforated plates 66 (representatively four in number) whose individual perforations are in registry with one another to combinatively form in the mounting plate structure 52 a spaced series of combustion air intake openings 60 that vertically extend from the bottom side of the mounting plate structure 52 to its top side. Alternatively, the perforated mounting plate structure could be formed from a single, thicker metal plate with the openings 60 formed therethrough, or be an unperforated mounting plate structure 52*a* as shown in FIG. 3A.

A gas burner 68 and an associated pilot and thermocouple assembly 70 are suitably secured to and project upwardly from the top side of the mounting plate structure 52 into the combustion chamber 18. To provide external visibility of the burner flame within the combustion chamber, a suitable sight glass structure of conventional construction (not shown) is provided on the water heater. A thermostatic gas supply valve 72, which monitors the temperature of the stored water 14 and correspondingly controls the firing of the burner 68, to maintain a predetermined tank water temperature, is externally mounted on the outer side of the jacket structure 34 on the left side of the water heater 10 as viewed in FIG. 1.

Thermostatic valve 72 receives a supply of gaseous fuel through a gas pipe 74 and is operatively coupled to (1) the burner 68 by a gas supply pipe 76, and (2) the pilot/thermocouple assembly 70 by a pilot gas line 78, the body 79 of the thermocouple portion of the assembly 70, and electrical wiring (not shown). Gas lines 76 and 78, the thermocouple body 79, and the electrical wiring sequentially extend downwardly from the gas valve 72 externally of the jacket structure 34, pass inwardly into the interior of the skirt 22 via the jacket and skirt access openings 46 and 32, and then extend upwardly through the mounting plate structure to connect to the burner 68 and the pilot/thermocouple assembly 70. In this manner, the piping and wiring are advantageously kept out of the interior of the hot combustion chamber 18.

Figure 4:
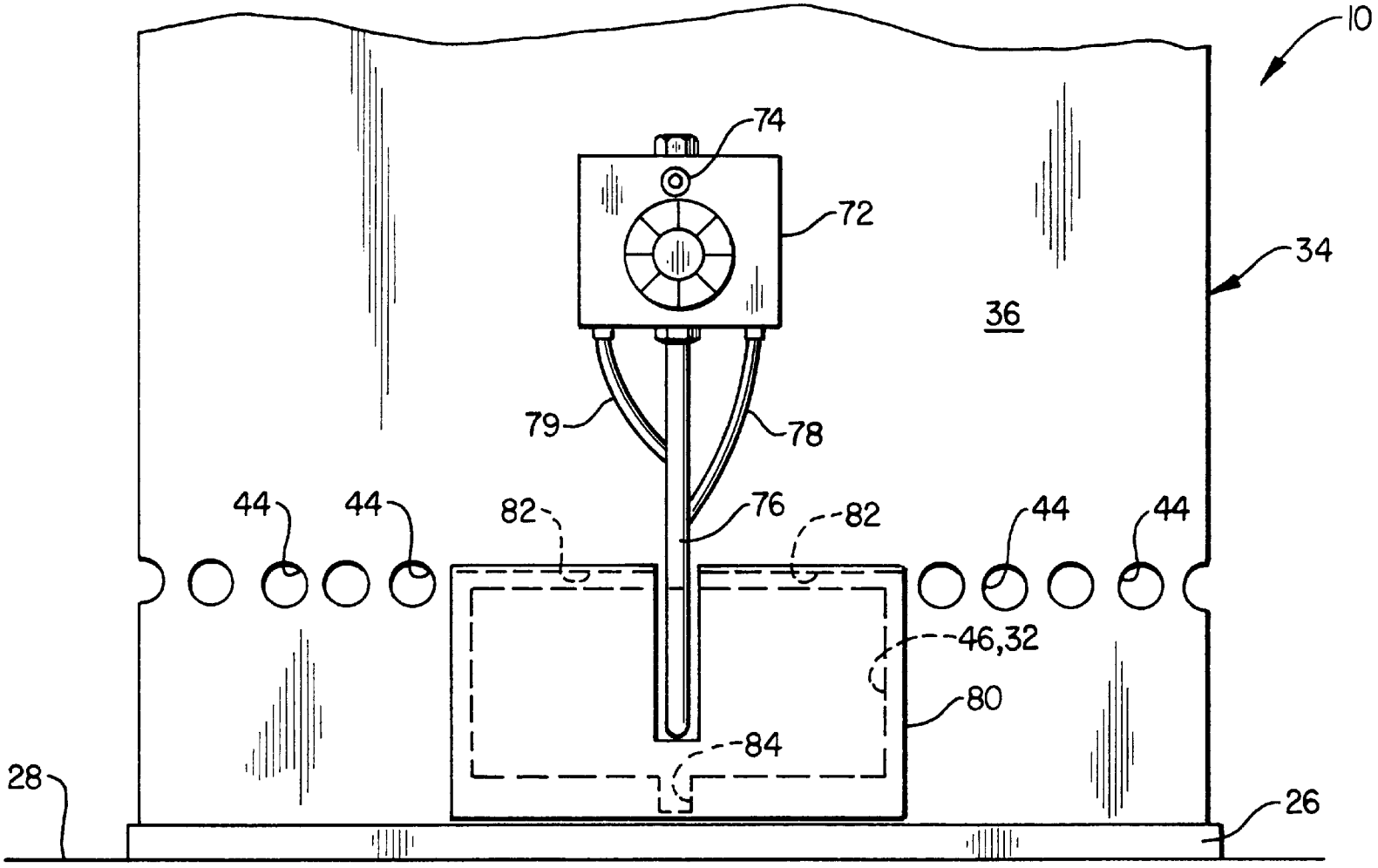
FIG. 4 is a side elevational view of the water heater taken along line 4—4 of FIG. 1.

As best illustrated in FIG. 4, a notched cover plate 80 is removably secured to the outer side of the jacket structure 34 over the jacket access opening 46 by means of flanges 82 formed on top side portions of the cover plate and removably interlocked with corresponding flanges formed on the outer metal jacket portion 36. For purposes later described herein, bottom side portions of the aligned access openings 46,32 (see FIG. 4) are notched as at 84.

As illustrated in FIG. 1, during operation of the water heater 10, while the burner 68 is firing, ambient combustion air 86 exteriorly adjacent the water heater 10 is sequentially drawn inwardly through the jacket openings 44, downwardly through the skirt/jacket plenum area 42, inwardly through the skirt wall openings 30 into the interior of the skirt 22, and upwardly into the combustion chamber 18 via the openings 60 in the bottom side wall structure 48 and the mounting plate structure 52. The air 86 entering the combustion chamber 18 mixes and is combusted with fuel exiting the burner 68. The resulting hot combustion gases flow upwardly through the flue tube 20 and are used to supply heat to the tank water 14.

Figure 1A:
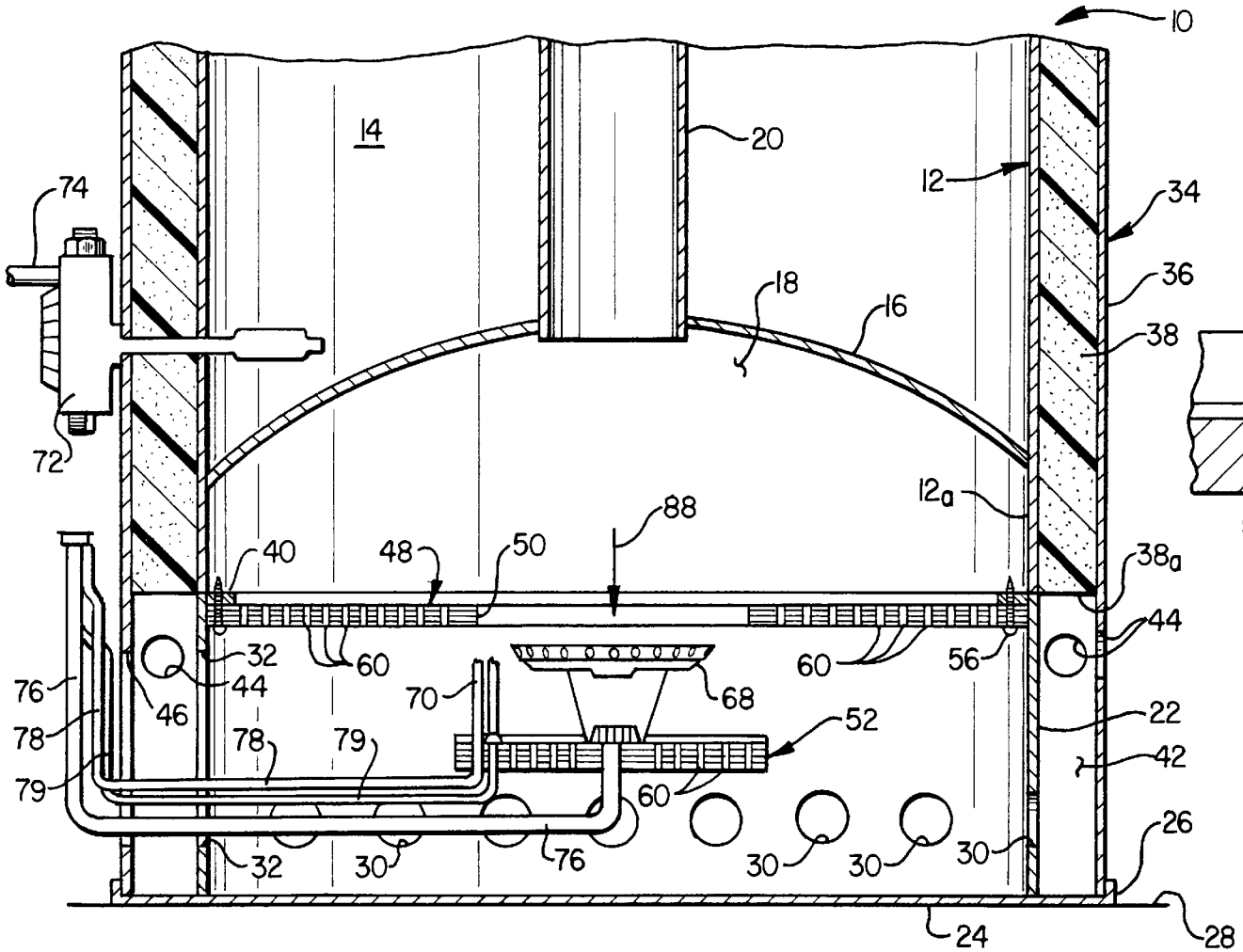
FIG. 1A is a view similar to that in FIG. 1, but with the burner and pilot assembly downwardly removed from the lower end of the water heater.

When it becomes necessary to inspect, service or replace the burner 68 and/or the pilot/thermocouple assembly 70, the cover plate 80 (see FIG. 4) is removed and the pipes 76 and 78, the thermocouple body 79, and the associated electrical wiring (not shown) are decoupled from the thermostatic gas valve 72. Additionally, via the jacket and skirt access openings 46 and 32 the screws 64 (see FIG. 1) are removed from the mounting plate structure 52. Then, as indicated by the arrow 88 in FIG. 1A, the mounting plate structure 52 is downwardly removed from the bottom side of the bottom side wall structure 48, thereby lowering the mounting plate structure 52, the burner 68, the pilot/thermocouple structure 70 and the associated piping 76,78 and thermocouple body 79 to their FIG. 1A positions. The aligned access openings 46,32 are configured to permit the downward movement of the horizontal portion of the gas supply pipe 76, with the bottom side notches 84 of such access openings receiving a horizontal portion of the pipe 76. The removed mounting plate, burner, pilot/thermocouple assembly and relating piping structures may be pulled leftwardly out of the aligned access openings 46,32.

By mounting the burner 68 and the pilot/thermocouple assembly 70 on the bottom side wall structure 48 of the combustion chamber 18 using the mounting plate structure 52, several advantages are gained over conventional water heater design in which access to the combustion chamber is provided by an access door which is mounted on a vertical side wall portion of the combustion chamber.

First, these conventional vertically oriented access door structures are typically formed from several pieces, at least one of which is provided with openings for the main burner and pilot gas piping to pass through into a horizontally central portion of the combustion chamber. This access door placement and construction necessitates the use of several seal elements which must be carefully installed when the water heater is manufactured, and then carefully replaced after subsequently servicing the burner and pilot structures. By using the bottom mounted cover plate structure 52 of the present invention, however, only a single seal (representatively, the gasket member 62 shown in FIGS. 3 and 3A) is required. This makes it considerably easier to assure that a good seal is maintained at the combustion chamber opening 50.

Second, conventionally configured, vertically oriented combustion chamber access doors are typically openable during firing of the burner within the combustion chamber, thereby communicating the burner flame with the ambient environment exterior to the water heater. In the present invention, however, this condition cannot occur since to uncover the combustion chamber bottom side wall opening 50 it is necessary to decouple the gas piping from the thermostatic gas valve 72, thereby positively precluding the presence of a flame within the combustion chamber when the opening 50 is uncovered.

Third, as can be seen in FIG. 1, in the present invention the gas piping 76,78 is disposed entirely externally of the combustion chamber 18—no portion of such piping need be run through the hot interior of the combustion chamber. Additionally, the horizontal run of the piping 76,78 is desirably supported by the mounting plate structure 52 such that neither the burner 68 nor the pilot/thermocouple assembly 70 exert a cantilever load on such piping.

The combustion chamber 18 is generally sealed except at the combustion air intake openings 60 in the bottom side wall structure 48 and the mounting plate structure 52 (or only in the bottom side wall structure 48 in the embodiment shown in FIG. 3A). Thus, the openings 60 define essentially the sole passage through which the combustion air 86 may enter the interior of the combustion chamber 18. According to another key feature of the present invention, the spacing and configurations of the openings 60 are selected to cause the openings 60 to (1) allow the combustion air 86 to flow upwardly through the openings 60 with a pressure drop which is sufficiently low so as to not materially impede the normal combustion process of the fuel-fired water 10, while at the same time (2) act as flame arresting passages that hinder a downward flow of flames through the openings 60 in the event that flammable vapors passing upwardly through the openings 60 are ignited within the combustion chamber 18.

To provide the combustion air inlet openings 60 with these two characteristics, their hydraulic or effective diameters and their passage lengths are selected in a manner such that upward air inlet flow through the openings 60 can occur with minimal pressure drop, but the openings 60 act to decrease downward flame propagation velocity therethrough in a manner extracting sufficient heat from such downwardly directed flames to quench them before they downwardly exit the openings 60. In this manner, downward flame outflow through the bottom ends of the openings 60, caused by ignition within the combustion chamber 18 of flammable vapors upwardly entering the combustion chamber through the openings 60, is hindered to thereby reduce the possibility of such ignition being spread to flammable vapors externally adjacent the combustion chamber 18.

There are two primary flame control situations which should be considered in the context of water heater design. The first concerns high velocity flame (i.e., a flame having a propagation velocity greater than about 50 feet per second). To arrest a high velocity flame, the flame must be both decelerated and quenched. The second situation concerns low velocity flame (i.e., a flame having a propagation velocity less than about 50 feet per second) in which case flame quenching is usually sufficient to arrest the flame.

Whether or not a flame is quenched before it exits a passage through which it is traveling depends on several factors such as the passageway length, the effective or hydraulic diameter of the passageway, the approach velocity of the flame, the pressure differential between the inlet and outlet of the passageway, and the temperature of the material in which the passageway is formed. In turn, the flame approach velocity for a given fuel depends on the fuel and air mixture ratio. Maximum flame velocity occurs at a stoichiometric fuel/air ratio, while minimum velocity tends to occur at a lean fuel/air ratio. In general, as flame speed is increased the hydraulic diameter should be decreased and the passageway length increased.

In the depicted preferred embodiment of the present invention, the four stacked metal plates 58 in the combustion chamber bottom side wall structure 48 (and the four stacked metal plates 66 in the mounting plate structure 52 shown in FIG. 3) each have a thickness of approximately 0.063 inches. Accordingly, the total thickness of the each of the bottom side wall structure 48 and the mounting plate structure is approximately 0.25 inches. Thus, if each of these two structures is formed from a single layer of metal (preferably steel) the single metal layer would similarly have a thickness of approximately 0.25 inches.

Preferably, the diameter of each of the openings 60 is approximately 0.063 inches, and the center-to-center spacing of the openings 60 is approximately 0.125 inches. As previously mentioned, the openings 60 have circular cross-sections but could be provided with noncircular cross-sections, having equivalent hydraulic diameters, if desired.

In developing the water heater 10 of the present invention it has been found that the use of the specially configured combustion air inlet openings 60 at the bottom side of the combustion chamber 18 serves to quench low velocity flames, and quench and decelerate high velocity flames, in a manner hindering their downward outflow through the openings 60. While these flame backflow-arresting opening have been illustratively shown as being disposed along the bottom side of the combustion chamber 18, it will be appreciated by those of skill in this particular art that they could be located elsewhere on the water heater, and be effective for their intended purpose, as long as they define essentially the sole inlet passageway for combustion air entering the combustion chamber.

The foregoing detailed description is to be clearly understood as being given by way of illustration and example only, the spirit and scope of the present invention being limited solely by the appended claims.

What is claimed is:

1. A water heater comprising:

a tank adapted to hold a quantity of water;

a combustion chamber disposed beneath said tank and having a generally horizontal bottom side wall structure with a burner mounting opening extending upwardly therethrough;

a mounting plate structure positioned beneath said bottom side wall structure;

securing apparatus removably securing said mounting plate structure to said bottom side wall structure over said burner mounting opening;

a fuel burner secured to said mounting plate structure, for downward removal therewith from said bottom side wall structure, and projecting upwardly into said combustion chamber through said burner mounting opening;

a fuel valve device;

a fuel supply line disposed externally of said combustion chamber and operatively connected directly to said fuel burner, said fuel supply line being removably coupled to said fuel valve device and preventing downward removal of said mounting plate structure from said bottom side wall structure, and thus the removal of said fuel burner from said combustion chamber, until said fuel supply line is decoupled from said fuel valve device; and an air inlet path through which combustion air may be flowed into said combustion chamber.

2. The water heater of claim 1 wherein said water heater is a gas-fired water heater.

3. The water heater of claim 1 wherein said fuel valve device is a thermostatic fuel valve.

4. The water heater of claim 1 wherein said air inlet path includes a spaced series of openings formed in said bottom side wall structure.

5. The water heater of claim 4 wherein said air inlet path further includes a spaced series of openings formed in said mounting plate structure.

6. The water heater of claim 1 wherein said air inlet path has a portion operative to (1) freely permit combustion air inflow in a first direction therethrough into said combustion chamber, and (2) hinder flame outflow from combustion chamber through said air inlet path portion in a second direction opposite from said first direction.

7. The water heater of claim 6 wherein said air inlet path portion includes a spaced series of openings formed in said bottom side wall structure.

8. The water heater of claim 7 wherein said air inlet path portion further includes a spaced series of openings formed in said mounting plate structure.

9. The water heater of claim 8 wherein spaced series of openings formed in said bottom side wall structure and said mounting plate structure have predetermined hydraulic diameter characteristics causing them to quench a flame passing downwardly therethrough.

10. The water heater of claim 9 wherein said bottom side wall structure and said mounting plate structure are each approximately 0.25 inches thick, and each of said openings formed in said bottom side wall structure and said mounting plate structure has a generally circular cross-section with a diameter of approximately 0.063 inches.

11. The water heater of claim 10 wherein said spaced series of openings formed in said bottom side wall structure and said mounting plate structure have a center-to-center spacing of approximately 0.125 inches.

12. The water heater of claim 8 wherein each of said bottom side wall structure and said mounting plate structure is formed from a stacked plurality of perforated metal plates whose perforations are in registry with one another and combinatively define said spaced series of openings formed in said bottom side wall structure and said mounting plate structure.

13. The water heater of claim 8 wherein said combustion chamber is sealed except for said spaced series of openings formed in said bottom side wall structure and said mounting plate structure.

14. The water heater of claim 7 wherein said spaced series of openings formed in said bottom side wall structure have predetermined hydraulic diameter characteristics causing them to quench a flame passing downwardly therethrough.

15. The water heater of claim 14 wherein said bottom side wall structure is approximately 0.25 inches thick, and each of said spaced series of openings formed in said bottom side wall structure has a generally circular cross-section with a diameter of approximately 0.063 inches.

16. The water heater of claim 15 wherein said spaced series of openings formed in said bottom side wall structure have a center-to-center spacing of approximately 0.125 inches.

17. The water heater of claim 7 wherein said bottom side wall structure is formed from a stacked plurality of perforated metal plates whose perforations are in registry with one another and combinatively define said spaced series of openings formed in said bottom side wall structure.

18. The water heater of claim 7 wherein said combustion chamber is sealed except for said spaced series of openings formed in said bottom side wall structure.

19. A water heater comprising:

a tank adapted to hold a quantity of water;

a combustion chamber disposed beneath said tank and having a generally horizontal bottom side wall structure with a burner mounting opening extending upwardly therethrough;

a spaced series of combustion air inlet openings formed in said bottom side wall structure;

a hollow skirt structure extending downwardly beyond said bottom side wall structure and having a vertical side wall portion with a spaced series of inlet openings formed therein for permitting a combustion air inflow therethrough into the interior of said hollow skirt structure for delivery therefrom into said combustion chamber via said spaced series of combustion air inlet openings in said bottom side wall structure;

a mounting plate structure positioned beneath said bottom side wall structure over said burner mounting opening;

securing apparatus removably securing said mounting plate structure to said bottom side wall structure;

a fuel burner secured to said mounting plate structure, for removal therewith from said bottom side wall structure, and projecting upwardly into said combustion chamber through said burner mounting opening;

a fuel supply line disposed externally of said combustion chamber and operatively connected to said fuel burner; and an insulating jacket structure circumscribing said tank, said insulating jacket structure having an outer wall portion with a lower end section that outwardly circumscribes said skirt structure and defines therewith an air inlet plenum that outwardly circumscribes said skirt structure, said lower end section of said outer wall portion having a spaced series of air inlet openings therein that permit combustion air to flow inwardly therethrough into said air inlet plenum for delivery therefrom into the interior of said hollow skirt structure through said inlet openings in said vertical side wall portion thereof.

20. The water heater of claim 19 wherein said water heater is a gas-fired water heater.

21. The water heater of claim 19 wherein:

said vertical side wall portion of said hollow skirt structure and said outer wall portion of said insulating jacket structure have generally aligned access openings therein, said water heater further comprises a fuel valve device carried externally of said outer wall portion of said insulating jacket structure, said fuel supply line extends outwardly through said access openings and is removably coupled to said fuel valve device, and said mounting plate structure, said fuel burner and a portion of said fuel supply pipe are outwardly removable through said access openings when said fuel supply pipe is decoupled from said fuel valve and said mounting plate structure is removed from said bottom side wall structure of said combustion chamber.

22. The water heater of claim 19 wherein said spaced series of combustion air inlet openings formed in said bottom side wall structure are sized and configured to (1) freely permit upward combustion air inflow therethrough into said combustion chamber, and (2) hinder flame outflow downwardly therethrough from said combustion chamber.

23. The water heater of claim 22 wherein said spaced series of openings formed in said bottom side wall structure have predetermined hydraulic diameter characteristics causing them to quench a flame passing downwardly therethrough.

24. The water heater of claim 23 wherein said bottom side wall structure is approximately 0.25 inches thick, and each of said spaced series of openings formed in said bottom side wall structure has a generally circular cross-section with a diameter of approximately 0.063 inches.

25. The water heater of claim 24 wherein said spaced series of openings formed in said bottom side wall structure have a center-to-center spacing of approximately 0.125 inches.

26. The water heater of claim 23 wherein said bottom side wall structure is formed from a stacked plurality of perforated metal plates whose perforations are in registry with one another and combinatively define said spaced series of openings formed in said bottom side wall structure.

27. The water heater of claim 19 wherein:

said spaced series of air inlet openings in said lower end section of said outer wall portion of said insulating jacket structure are positioned at a higher level than said inlet openings in said vertical side wall portion of said hollow skirt structure.

28. The water heater of claim 19 wherein:

said water heater further comprises a fuel valve device to which said fuel supply line is removably coupled, and said fuel supply line prevents removal of said mounting plate structure from said bottom side wall structure, and thus removal of said fuel burner from said combustion chamber, until said fuel supply line is decoupled from said fuel valve device.

* * * * *